US007488279B2

(12) United States Patent
Daniel

(10) Patent No.: US 7,488,279 B2
(45) Date of Patent: Feb. 10, 2009

(54) HANDLEBAR WITH ADJUSTABLE CABLE

(75) Inventor: Nir Daniel, 3 Belkind Street, Tel-Aviv 69154 (IL)

(73) Assignee: Nir Daniel, Tel-Aviv (IL)

( * ) Notice: Subject to any disclaimer, the term of this patent is extended or adjusted under 35 U.S.C. 154(b) by 455 days.

(21) Appl. No.: 10/512,638

(22) PCT Filed: May 1, 2003

(86) PCT No.: PCT/IL03/00355

§ 371 (c)(1),
(2), (4) Date: Oct. 27, 2004

(87) PCT Pub. No.: WO03/092820

PCT Pub. Date: Nov. 13, 2003

(65) Prior Publication Data

US 2005/0187077 A1 Aug. 25, 2005

Related U.S. Application Data

(60) Provisional application No. 60/376,541, filed on May 1, 2002.

(51) Int. Cl.
*A63B 71/00* (2006.01)
*A63B 21/06* (2006.01)

(52) U.S. Cl. ..... 482/139; 482/93

(58) Field of Classification Search ..... 482/51–57, 482/44–50, 93, 139, 112; 119/794–796
See application file for complete search history.

(56) References Cited

U.S. PATENT DOCUMENTS

| | | | | |
|---|---|---|---|---|
| 3,453,917 | A | 7/1969 | Perry | |
| 3,792,860 | A | 2/1974 | Selnes | |
| 4,708,004 | A * | 11/1987 | Allen | 70/226 |
| 5,595,143 | A * | 1/1997 | Alberti | 119/794 |
| 5,906,140 | A * | 5/1999 | Smith | 74/502.2 |
| 6,024,054 | A * | 2/2000 | Matt et al. | 119/796 |
| 6,405,683 | B1 * | 6/2002 | Walter et al. | 119/772 |
| 6,595,031 | B2 * | 7/2003 | Wilson et al. | 70/233 |
| 6,862,948 | B1 * | 3/2005 | Calendrille, Jr. | 74/502.2 |
| 2003/0114278 | A1 * | 6/2003 | Rigas | 482/116 |

OTHER PUBLICATIONS

International Search report of Application PCT/IL03/00355 Issued on Sep. 15, 2004.

* cited by examiner

*Primary Examiner*—Fenn C Mathew
(74) *Attorney, Agent, or Firm*—Pearl Cohen Zedek Latzer, LLP

(57) ABSTRACT

An adjustable handlebar having a handlebar body, a locking mechanism associated with the handlebar body and able to engage a cable, and an engagement-control mechanism to allow control engagement of the cable by the locking mechanism

12 Claims, 7 Drawing Sheets

HANDLEBAR WITH ADJUSTABLE CABLE

CROSS-REFERENCE TO RELATED APPLICATIONS

This application is a National Phase Application of PCT International Application No. PCT/IL2093/000355, International Filing Date May 1, 2003, claiming priority of U.S. Provisional Patent Application, 60/376,541, filed May 1, 2002, both incorporated herein by reference.

FIELD OF THE INVENTION

The present invention relates generally to the field of weight training equipment and, more specifically, to the field of weight training equipment having handlebars connected to a weight through a wire or cable.

BACKGROUND OF THE INVENTION

Weight-training machines are widely used by professional athletes and are becoming increasingly popular with the general population as more people join health clubs or "gyms". Weight training machines are commonly adjusted to provide a desired resistance when a user utilizes a specific muscle or muscle group. It would be beneficial to improve the efficiency and safety with which weight-training machines may be adjusted by a user.

SUMMARY OF THE INVENTION

In accordance with exemplary embodiments of the invention, there is provided a handlebar with a cable locking mechanism. The cable locking mechanism may include a first clamping surface of a first clamping member interfacing a second clamping surface of a second clamping member.

According to embodiments of the invention, at least one of the two clamping members may be associated with an urging mechanism adapted to urge the two clamping members towards each other. The urging mechanism may include, for example, an urging spring.

According to some exemplary embodiments of the invention, at least one of the two clamping members may be associated with an engagement-control mechanism controllable by the user.

According to exemplary embodiments of the invention, the engagement-control mechanism may have a pressed mode and a released mode.

According to other exemplary embodiments of the invention, there is provided a method for adjusting a handlebar The method may include controllably releasing engagement of a cable by a locking mechanism associated with a handlebar body. The method may further include moving the handlebar body to a desired position and controllably resuming engagement of the cable by the locking mechanism.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
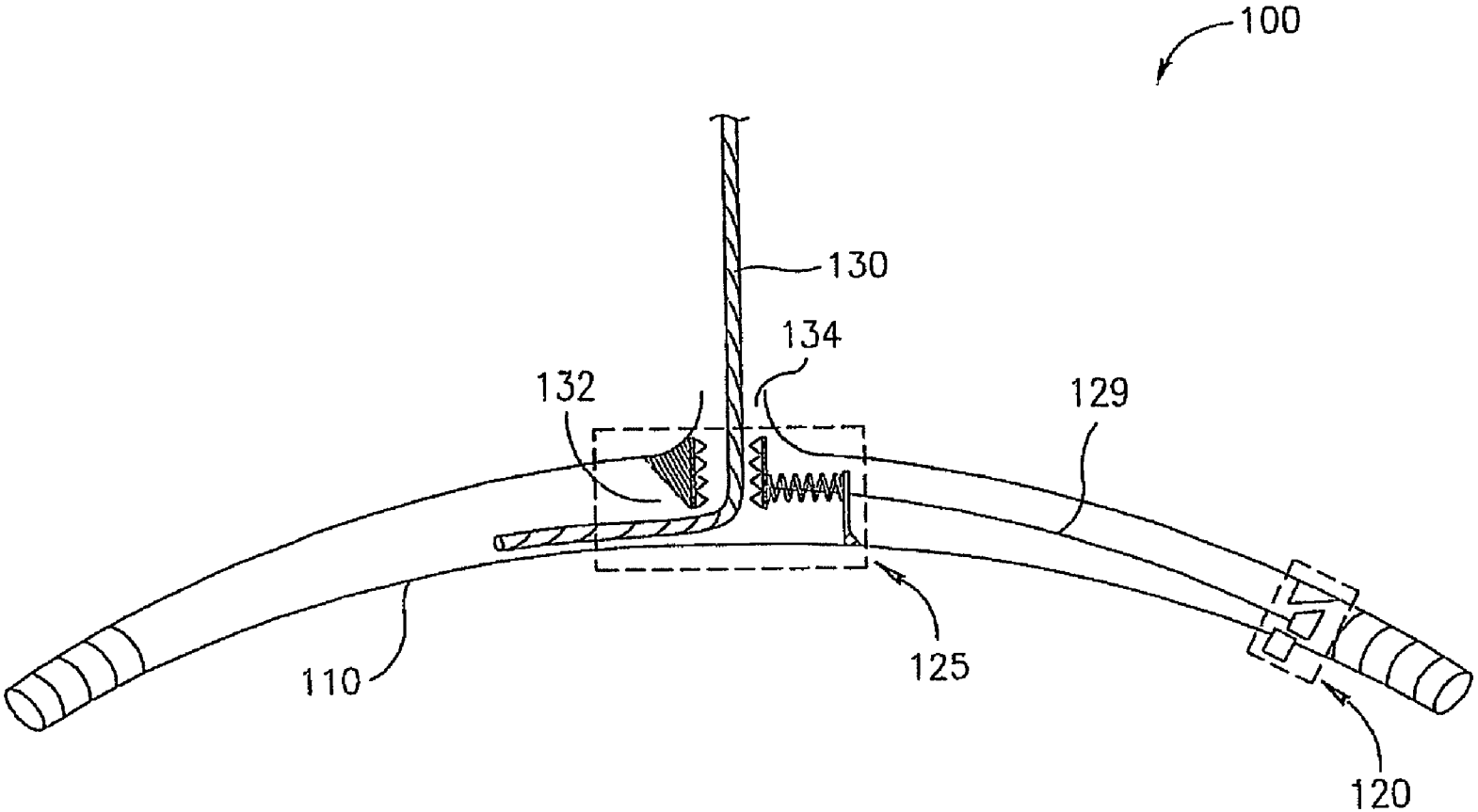
FIG. 1 is a schematic illustration of an adjustable handlebar in accordance with one exemplary embodiment of the present invention.

It will be appreciated that for simplicity and clarity of illustration, elements shown in the figures have not necessarily been drawn accurately or to scale. For example, the dimensions of some of the elements may be exaggerated relative to other elements for clarity or several physical components included in one element. Further, where considered appropriate, reference numerals may be repeated among the figures to indicate corresponding or analogous elements. It will be appreciated that these figures present examples of embodiments of the present invention and are not intended to limit the scope of the invention.

DETAILED DESCRIPTION OF EMBODIMENTS OF THE INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, components and circuits may not have been described in detail so as not to obscure the present invention.

Reference is made to FIG. 1, which schematically illustrates an adjustable handlebar 100 in accordance with one exemplary embodiment of the present invention.

Adjustable handlebar 100 may include a handlebar body 110, and a cable locking mechanism 125 to. allow locking of a cable 130, which may be operatively connected to a weight or a load (not shown in FIG. 1). Adjustable handlebar 100 may further include an engagement-control mechanism 120, which may be operatively associated with cable locking mechanism 125 as described below. According to other embodiments of the invention, cable 130 may be any means for operatively associating the handlebar with the weight or load, for example, a chain.

In exemplary embodiments of the invention, cable-locking mechanism 125 may be located in a handlebar cavity 132 in the proximity of a handlebar aperture 134 of handlebar body 110. Aperture 134 may allow insertion of cable 130 into handlebar cavity 132.

In some embodiments of the invention, engagement-control mechanism 120 may be adapted to switch between a closed/locked mode and an open/unlocked mode of cable locking mechanism 125 as explained in detail below.

Figure 2:
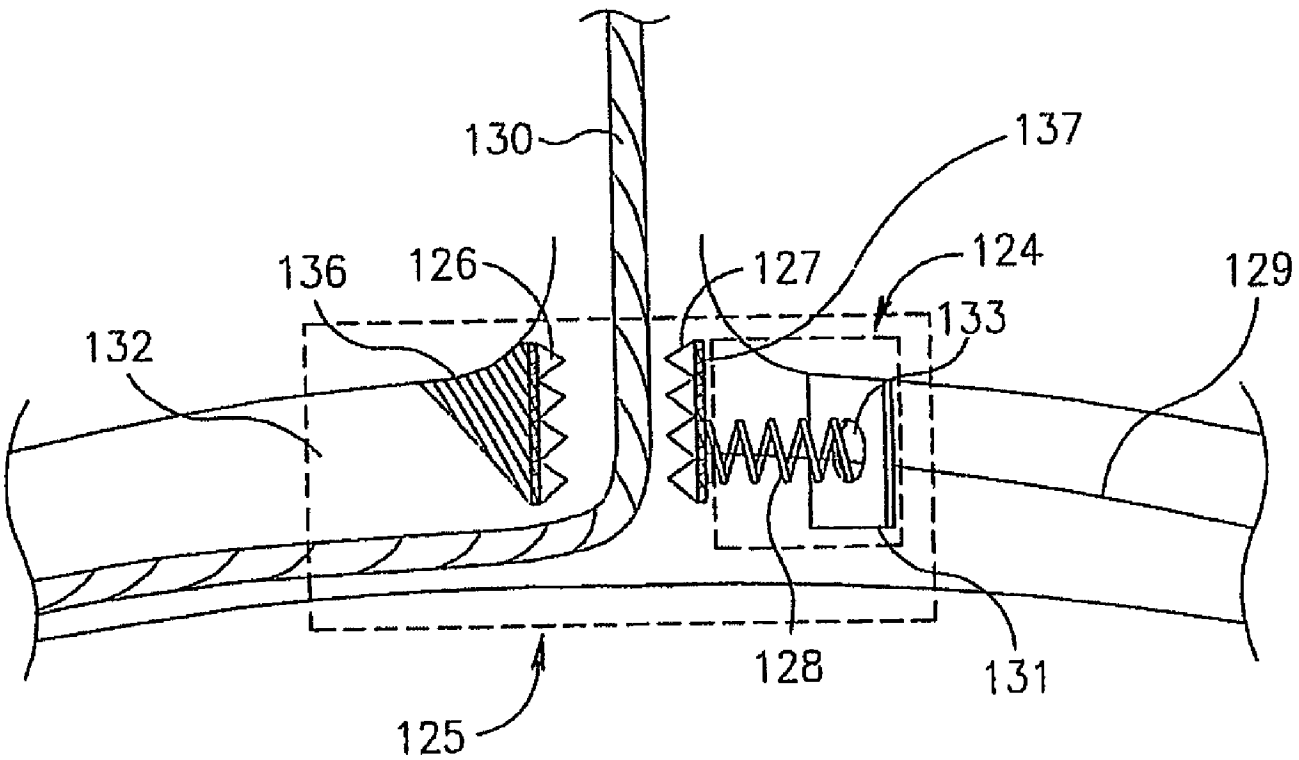
FIG. 2 is a schematic illustration of a cable locking mechanism that may be used in conjunction with the adjustable handlebar of FIG. 1.

Reference is also made to FIG. 2, which schematically illustrates cable-locking mechanism 125 in accordance with exemplary embodiments of the present invention. According to some exemplary embodiments of the invention, cable-locking mechanism 125 may include a first clamping member 136 interfacing a second clamping member 137. First clamping member 136 may have a first clamping surface 126 and second clamping member 137 may have a second clamping surface 127. According to some embodiments of the invention, first clamping surface 126 and second clamping surface 127 may be positioned opposite to each other, and second clamping member 137 may be adapted to advance substantially in the direction of first clamping surface 126 to allow clamping of a cable 130 passing substantially in between surfaces 126 and 127. First clamping surface 126 and/or second clamping surface 127 may be rough and/or jagged surfaces or may be designed in any other way to allow a firm grip of cable 130 when engaged.

In an exemplary embodiment of the invention, cable-locking mechanism 125 may further include an urging mechanism 124 adapted to urge second clamping member 137 towards first clamping member 136. The urging mechanism may include, for example, an urging spring 128 for urging members 136 and 137 towards one another with sufficient force to allow a firm engagement of surfaces 126 and 127 with cable 130. Any other device, such as a magnet, may be used to apply a desired force to allow firm engagement of clamping surfaces 126 and 127.

According to an exemplary embodiment of the invention, spring 128 may be attached to second clamping member 137 as well as to a tab 131 which may be attached to an inner surface of handlebar cavity 132.

According to a further embodiment of the invention, a wire 129 may pass through spring 128 and/or through a tab aperture 133 in tab 131 and may be used to operatively associate second clamping member 137 with engagement-control mechanism 120 (FIG. 1).

According to exemplary embodiments of the invention, first clamping member 136 may be attached to an inner surface of handlebar cavity 132. However, it should be understood that according to other embodiments of the invention, first clamping member 136 may include an urging mechanism, e.g., a mechanism similar to that used for second clamping member 137 described above, wherein either or both of interfacing surfaces 126 and 127 may be active in the locking/engagement of cable 130.

Figure 3:
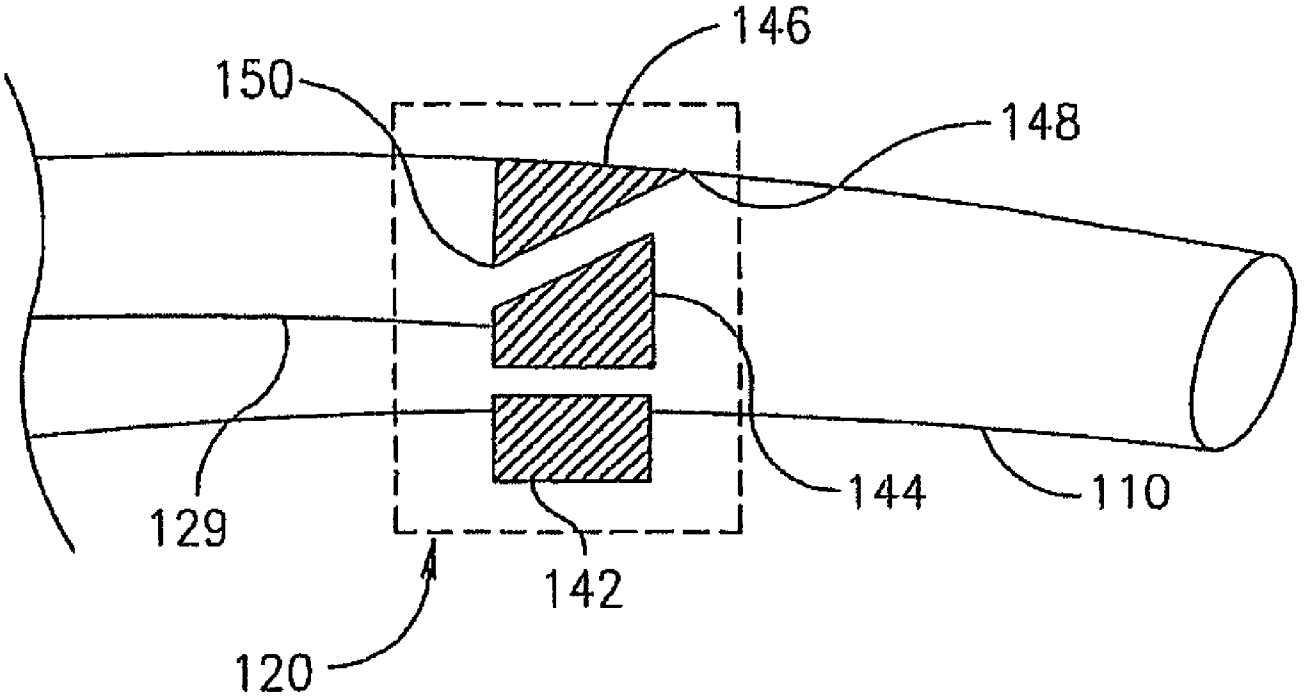
FIG. 3 is a schematic illustration of an engagement-control mechanism that may be used in conjunction with the adjustable handlebar of FIG. 1.

Reference is also made to FIG. 3, which schematically illustrates engagement-control mechanism 120 in accordance with exemplary embodiments of the present invention.

Engagement-control mechanism 120 may include, according to an exemplary embodiment of the invention, a trigger 142, a graded protrusion 146 and a slidable member 144 associated with wire 129 and adapted to slide on graded protrusion 146. According to an embodiment of the invention, trigger 142 may be a depressible control button having a pressed mode and a released mode. In the pressed mode, trigger 142 may be adapted to drive slidable member 144 substantially in the direction of a distal end 148 of graded protrusion 146, thereby causing wire 129 to urge second clamping member 137 substantially away from first clamping member 136, thus opening cable locking mechanism 125. This causes spring 128 to contract and, thus, allows cable 130 to move substantially freely. Upon release of trigger 142, spring 128 may drive second clamping member 137 substantially towards first clamping member 136, thereby causing clamping surfaces 126 and 127 to engage and substantially close cable locking mechanism 125. The movement of second clamping member 137 towards first clamping member 136 may cause wire 129 to pull slidable member 144 substantially in the direction of a proximal end 150 of graded protrusion 146. Slidable member 144 may be further adapted to push trigger 142 towards the released mode as it moves towards proximal end 150. Slidable member 144 and graded protrusion 146 may be further designed to prevent movement of the slidable member past proximal end 150.

It should be understood that any other suitable means, known or yet to be devised, may be used to apply pressure onto slidable member 144, and that the present invention is not limited to the use of trigger 142 or similar means.

Figure 4:
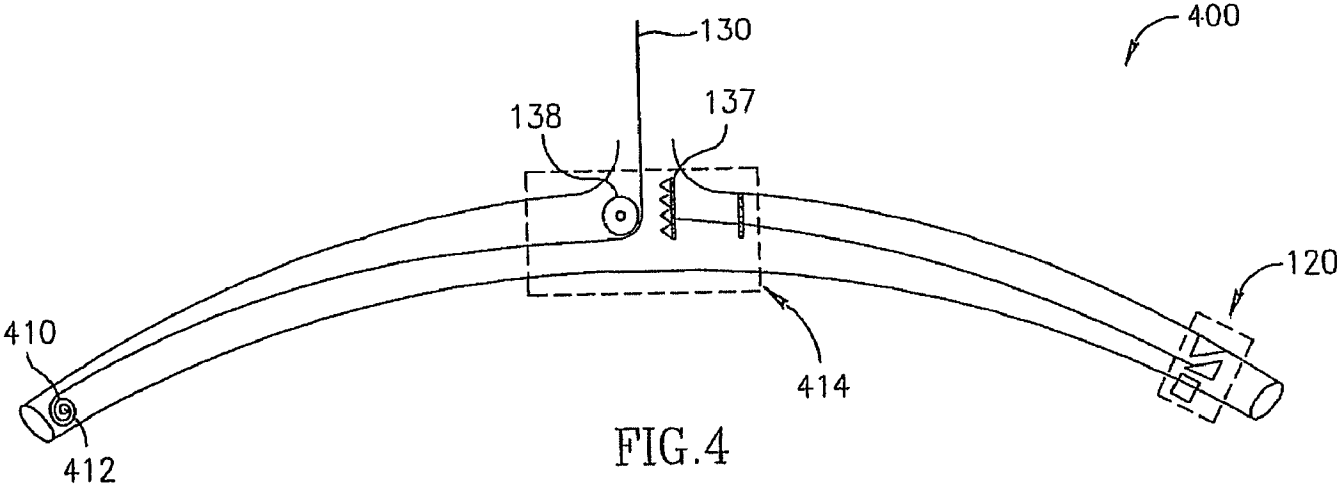
FIG. 4 is a schematic illustration of an adjustable handlebar in accordance with another exemplary embodiment of the present invention.

Reference is also made to FIG. 4, which schematically illustrates an adjustable handlebar 400 according to another exemplary embodiment of the present invention. In the embodiment shown, in addition to elements described above with reference to FIGS. 1-3, handlebar 400 may further include a cable reel 410 operatively connectable to cable 130. According to further embodiments of the invention, the reel may be disc-shaped and/or may comprise a reel spring 412 capable of providing sufficient force to wind cable 130, for example, around cable reel 410. In exemplary embodiments of the invention, cable reel 410 may be adapted to continuously wind cable 130 with sufficient force to substantially prevent slacking of cable 130 and maintain a desired minimum tension of cable 130. Reel 410 may be adapted to wind substantially all the redundant length of cable 130, such that, for example when cable locking mechanism 125 is open and handlebar 400 is pushed upwards, reel 410 may continuously wind the cable that may be rendered redundant, such that tension may be maintained at all times Reel 410 may also be configured to release a sufficient length of cable 130 when the cable is pulled. According to some embodiments of the present invention, a substantially small amount of force may be sufficient to cause the reel to release a desired length of cable 130, In exemplary embodiments of adjustable handlebar 400, first clamping member 136 of adjustable handlebar 100 of FIG. 1 may be replaced with a round member 138, which may have a smooth surface, such that when cable clamping mechanism 414 is open and handlebar 400 is moved upward or downward the cable may freely slide in or out of handlebar cavity 132. According to some exemplary embodiments of the present invention, member 138 may include a rotatable disc.

Figure 5:
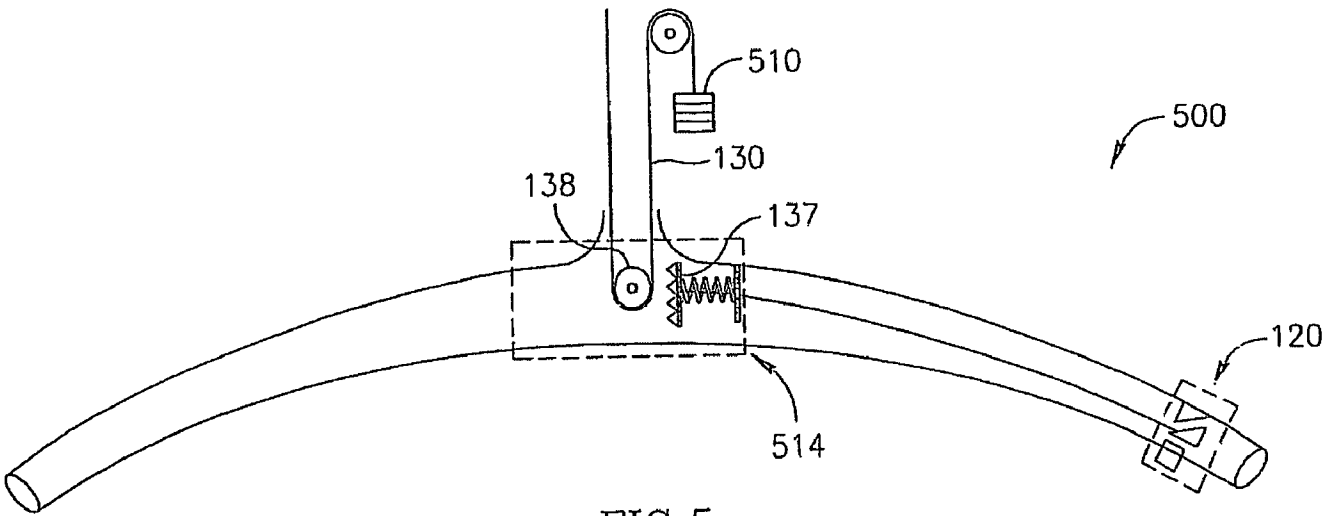
FIG. 5 is a schematic illustration of an adjustable handlebar according to a further exemplary embodiment of the present invention.

Reference is made now to FIG. 5, which schematically illustrates an adjustable handlebar 500 according to a further embodiment of the present invention. It will be appreciated by persons skilled in the art that elements of handlebar 500 analogous or similar to corresponding elements of handlebars 100 (FIG. 1) and/or 400 (FIG. 4) may be identified using the same reference numerals.

According to the embodiment of FIG. 5, cable 130 may be coupled to a tension-maintaining weight 510 which may be designed to maintain a desired minimum tension in cable 130, for example, a tension sufficient to pull redundant slack of cable 130 from cable locking mechanism 514. Tension-maintaining weight 610 may be adapted to pull substantially all the redundant length of cable 130. For example, when cable locking mechanism 514 is open and handlebar 500 is pushed upwards, weight 510 may pull the redundant cable, whereby sufficient tension may be maintained in the cable at all times. Tension-maintaining weight 510 may also be configured to release a desired length of cable 130 when the cable is pulled. According to some embodiments of the present invention, a substantially small amount of force may be sufficient to cause the tension-maintaining weight to release a desired length of cable 130. Tension-maintaining weight 510 may be loosely and slidably suspended away from the handlebar.

Figure 6:
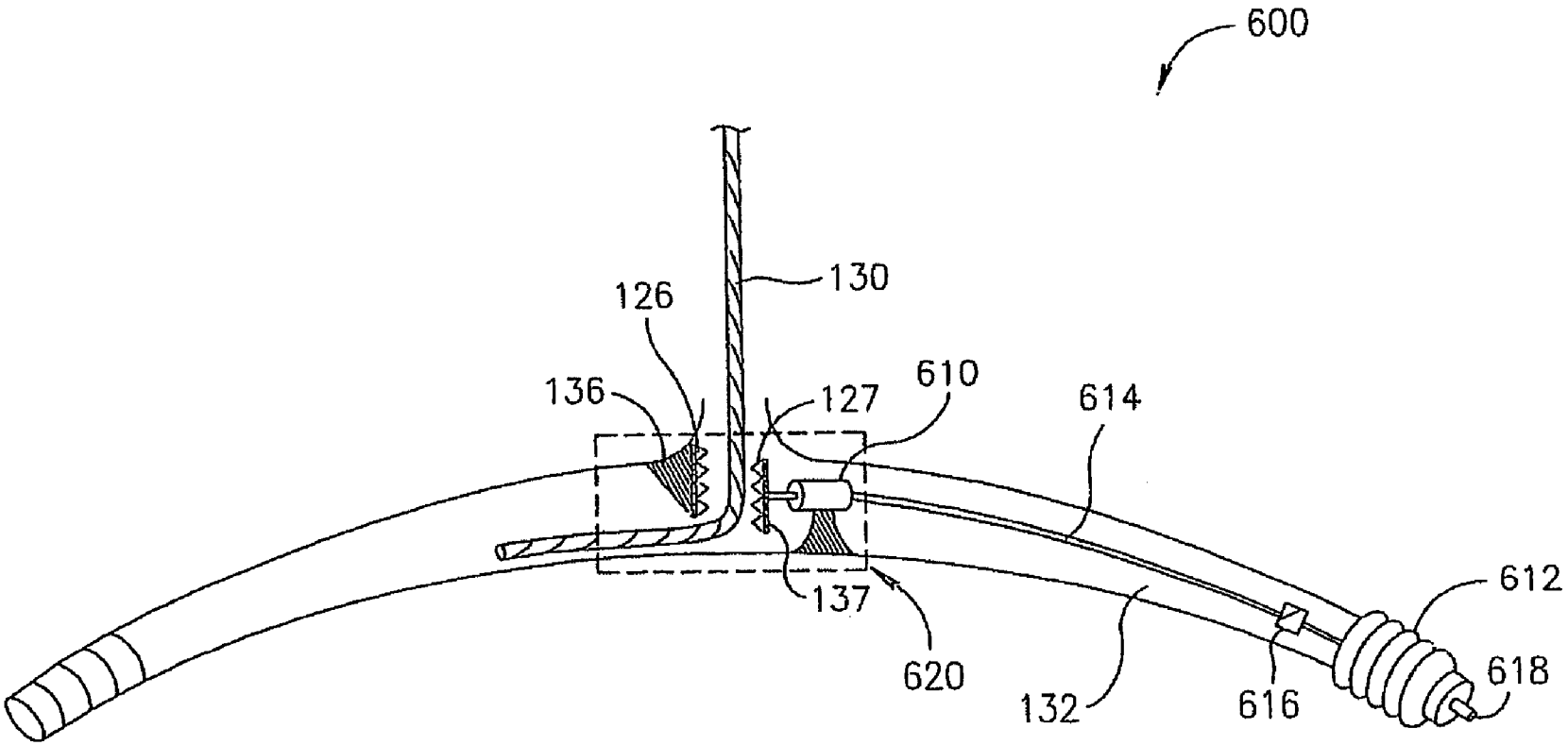
FIG. 6 is a schematic illustration of an adjustable handlebar according to yet another exemplary embodiment of the present invention.

Reference is now made to FIG. 6, which schematically illustrates an adjustable handlebar 600 according to yet another embodiment of the present invention. It will be appreciated by persons skilled in the art that elements of handlebar 600 analogous or similar to corresponding elements of handlebars 100 (FIG. 1) and/or 400 (FIG. 4) may be identified using the same reference numerals.

According to the embodiment of FIG. 6, handlebar 600 may include a pneumatic cylinder 610, which may be positioned within handlebar cavity 132, Pneumatic cylinder 610 may be adapted, when activated, to push second clamping member 137 substantially in the direction of first clamping member 136 such that first and second clamping surfaces 126 and 127 are engaged Handlebar 600 may further include a pneumatic pump 612, a pipe 614 connecting pump 612 and pneumatic cylinder 610, and a valve 616 associated with a release button 618. The pneumatic pump may be used to pump air and/or any other suitable displacement substance through pipe 614 and valve 616. Valve 616 may allow the displacement substance to progress or flow towards pneumatic cylinder 610 and may prevent the substance from progressing or flowing away from pneumatic cylinder 610, thereby causing pressure supplied by pump 612 to build up on pneumatic cylinder 610. Pneumatic cylinder 610 may push second clamping member 137 substantially in the direction of first clamping member 136. Second clamping member 137 may be urged substantially towards first clamping member 136 when a sufficient amount of displacement substance is provided to pneumatic cylinder 610 by pneumatic pump 612. Release button 618 may be adapted to allow the release of pressure on the pneumatic cylinder, consequently opening cable-locking mechanism 620.

Figure 7:
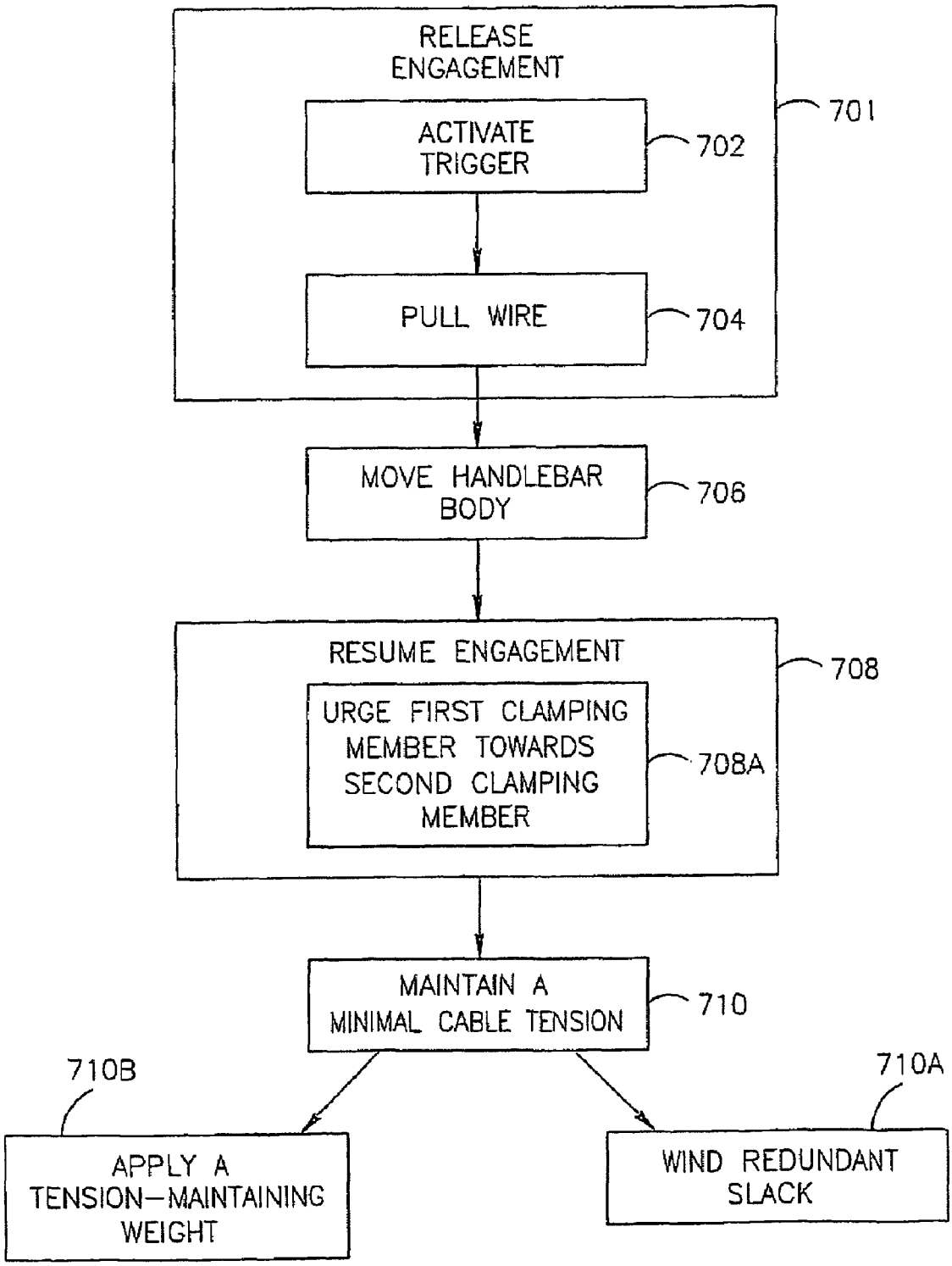
FIG. 7 is a schematic block illustration of a method for adjusting a handlebar according to exemplary embodiments of the invention.

Reference is made to FIG. 7, which is a block-diagram schematically illustrating a method for adjusting a handlebar according to exemplary embodiments of the invention.

The method may include controllably releasing engagement of cable 130 (FIG. 1) by locking mechanism 125 (FIG. 1) as indicated at block 701. This may be achieved, according to some exemplary embodiments of the invention, by pulling wire 129 (FIG. 1) as indicated at block 704. According to some of these embodiments, the method may include activating trigger 142 (FIG. 3) to pull the wire, as indicated at block 702.

As indicated at block 706, after releasing the engagement of the cable by the locking mechanism, the method may include moving handlebar body 110 (FIG. 1) to a desired position.

After positioning the handlebar, the method may further include resuming engagement of the cable by the locking mechanism, as indicated at block 708. This may be achieved, according to some exemplary embodiments, by urging second clamping member 137 (FIG. 3) towards first clamping member 136 (FIG. 3), as indicated at block 708A.

The method may also include maintaining a minimal desired tension in the cable, as indicated at block 710. This may be achieved according to one embodiment of the invention, by winding redundant slack of the cable, as indicated at block 710A According to another embodiment of the invention, this may alternatively be achieved by applying tension maintenance weight 510 (FIG. 5), as indicated at block 7110B.

Figure 8:
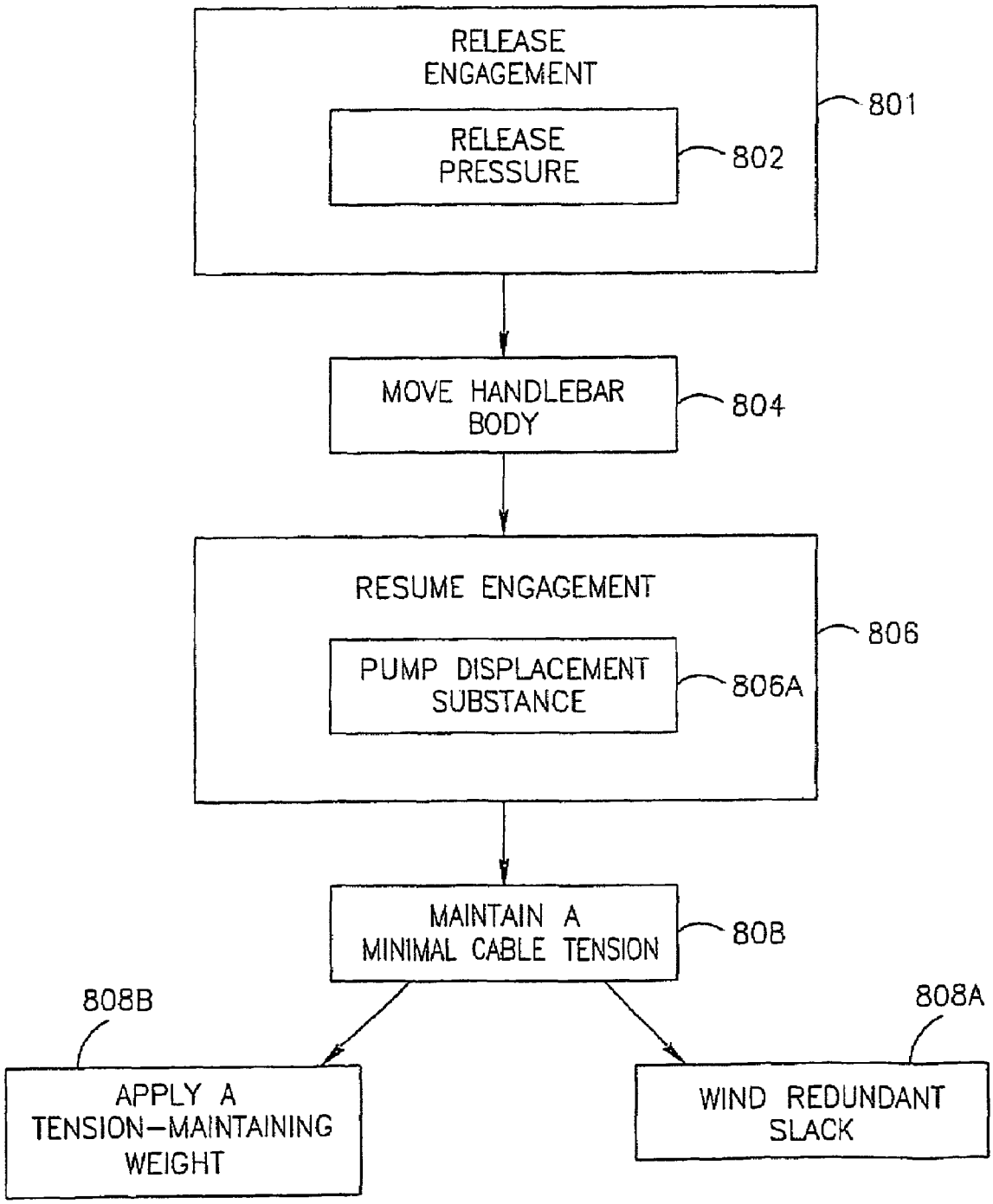
FIG. 8 is a schematic block illustration of an alternative method for adjusting a handlebar according to exemplary embodiments of the invention.

FIG. 8 is a schematic block illustration of an alternative method for adjusting a handlebar according to exemplary embodiments of the invention.

The alternative method may include controllably releasing engagement of cable 130 (FIG. 1) by locking mechanism 125 (FIG. 1) as indicated at block 801. This may be achieved, according to some exemplary embodiments of the invention, by releasing pressure applied by a displacement substance to pneumatic cylinder 610 (FIG. 6), as indicated at block 802.

As indicated at block 804, after releasing the engagement of the cable by the locking mechanism, the alternative method may include moving handlebar body 110 (FIG. 1) to a desired position.

After positioning the handlebar, the method may further include resuming engagement of the cable by the locking mechanism, as indicated at block 806. This may be achieved, according to some exemplary embodiments, by pumping displacement substance to re-apply pressure to the pneumatic cylinder, as indicated at block 806A.

The alternative method may also include maintaining a minimal desired tension in the cable, as indicated at block 808. This may be achieved according to one embodiment of the invention, by winding redundant slack of the cable, as indicated at block 808A. According to another embodiment of the invention, this may alternatively be achieved by applying tension maintenance weight 510 (FIG. 5), as indicated at block 808B.

While the invention has been described with respect to a limited number of embodiments, it will be appreciated that many variations, modifications and other applications of the invention may be made. Embodiments of the present invention may include other apparatuses for performing the operations herein. Such apparatuses may integrate the elements discussed, or may comprise alternative components to carry out the same purpose. It will be appreciated by persons skilled in the art that the appended claims are intended to cover all such modifications and changes as fall within the true spirit of the invention.

What is claimed is:

1. A handlebar for a weight training machine comprising:

a handlebar body;

means for operatively associating said handlebar with a weight, said means comprising a device selected from the group consisting of: a cable and a chain;

a locking mechanism associated with said handlebar body and able to engage said handlebar body to said means for operatively associating said handlebar with weight; and an engagement-control mechanism to allow a user to control the engagement of said handlebar to said means for operatively associating said handlebar with said weight by said locking mechanism to set the position at which said handlebar is engaged to said means for operatively associating said handlebar with weight;

wherein said engagement-control mechanism comprises a pneumatic pump to provide displacement substance via a pipe to a pneumatic cylinder associated with said locking mechanism.

2. The handlebar of claim 1 wherein said pipe comprises a valve having a release button.

3. The handlebar of claim 1, wherein said means for operatively associating said handlebar wit weight is selected from a list comprising a cable, a wire and a chain.

4. A method for adjusting the position at which a handlebar is engaged to a means operatively associating it with weight in a weight training machine comprising:

controllably releasing engagement of said means for operatively associating said handlebar with weight by a locking mechanism associated with said handlebar body;

moving said handlebar body to a desired position along said means for operatively associating said handlebar with weight; and controllably resuming engagement of said handlebar body to said means for operatively associating said handlebar with weight by said locking mechanism wherein said means comprising a device which is at least one of a cable and a chain.

5. The method of claim 4 wherein controllably releasing engagement of said means for operatively associating said handlebar with weight comprises pulling a wire associated with said locking mechanism with sufficient force to open said locking mechanism.

6. The method of claim 5 wherein controllably releasing engagement of said means for operatively associating said handlebar with weight comprises activating a trigger to drive a slidable member to pull said wire.

7. The method of claim 4 further comprising maintaining at least a minimum tension in said means for operatively associating said handlebar with weight.

8. The method of claim 7 wherein maintaining at least a minimum tension in said means for operatively associating said handlebar with weight comprises winding redundant slack of said means for operatively associating said handlebar with weight.

9. The method of claim 7 wherein maintaining a minimal tension in said means for operatively associating said handlebar with weight comprises applying a tension-maintaining spring to said means for operatively associating said handlebar with weight.

10. The method of claim 4 wherein controllably releasing engagement of said means for operatively associating said handlebar with weight comprises releasing pressure applied by a displacement substance to a pneumatic cylinder associated with said locking mechanism.

11. The method of claim 10 wherein controllably resuming engagement of said means for operatively associating said handlebar with weight comprises pumping displacement substance to re-apply pressure to said pneumatic cylinder.

12. The method of claim 4, wherein said means for operatively associating said handlebar with weight is selected from a list comprising a cable; a wire and a chain.

* * * * *